US008756757B2

(12) United States Patent
Tran

(10) Patent No.: US 8,756,757 B2
(45) Date of Patent: Jun. 24, 2014

(54) VACUUM CLEANER WITH BELT DRIVE DISENGAGER

(75) Inventor: Phong Hoang Tran, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 404 days.

(21) Appl. No.: 13/227,049

(22) Filed: Sep. 7, 2011

(65) Prior Publication Data

US 2013/0055526 A1 Mar. 7, 2013

(51) Int. Cl.
*A47L 5/12* (2006.01)

(52) U.S. Cl.
CPC ..... *A47L 5/12* (2013.01)
USPC ..... 15/390; 15/391

(58) Field of Classification Search
CPC ..... A47L 5/12
USPC ..... 15/389–391
IPC ..... A47L 5/12
See application file for complete search history.

(56) References Cited

U.S. PATENT DOCUMENTS

| | | | | |
|---|---|---|---|---|
| 2,174,560 | A | 10/1939 | Becker | |
| 4,748,714 | A | 6/1988 | Tschudy | |
| 5,031,267 | A | 7/1991 | Bewley | |
| 5,537,712 | A | 7/1996 | Weber et al. | |
| 6,158,084 | A | 12/2000 | Weber et al. | |
| 6,915,544 | B2 | 7/2005 | Roney et al. | |
| 7,120,964 | B2 | 10/2006 | Roney | |
| 7,318,250 | B2 | 1/2008 | Roney | |
| 7,426,770 | B2 | 9/2008 | Moon | |
| 8,516,655 | B2 * | 8/2013 | Maurer et al. | 15/391 |
| 2010/0017999 | A1 | 1/2010 | Bassett | |

FOREIGN PATENT DOCUMENTS

GB 2081074 A 2/1982

OTHER PUBLICATIONS

Claus Blumenberg, European Search Report, Oct. 16, 2012, Munich.

* cited by examiner

*Primary Examiner* — David Redding
(74) *Attorney, Agent, or Firm* — McGarry Bair PC

(57) ABSTRACT

A belt drive disengaging assembly for a vacuum cleaner includes a pivoting belt tensioner and an actuator assembly, wherein movement of the actuator assembly selectively pivots the belt tensioner to place tension on a belt coupled between an agitator and source of driving power, thereby coupling the agitator with the source of driving power.

20 Claims, 14 Drawing Sheets

VACUUM CLEANER WITH BELT DRIVE DISENGAGER

BACKGROUND OF THE INVENTION

Vacuum cleaners can include an agitator for agitating debris on a surface to be cleaned so that the debris is more easily ingested into the vacuum cleaner. In some cases, the agitator comprises a motor-driven brushroll that rotates within a base assembly or floor nozzle and is driven by a belt coupled with the motor. Vacuum cleaners with rotating agitators are often provided with a device for stopping agitator motion by disengaging the belt drive. Such belt drive disengaging devices allow the motor to remain on, but stops the agitator from rotating by physically moving or putting slack in the belt. This is useful when the vacuum cleaner is used for cleaning uncarpeted or bare floors, including hardwood, linoleum, tile, and tatami floors. Otherwise, the rotating agitator can generate air currents that push lightweight dust and debris away from the agitator so that they are not drawn through the suction nozzle and collected. A rotating agitator can also damage certain bare floors. It is also often desirable to disengage the belt drive when the vacuum cleaner is left stationary and used for above-the-floor cleaning, as even more robust floor coverings might be damaged by the rotating agitator.

One general type of belt disengager is a "belt tightener" or "belt tensioner." In this type of agitator drive system, the drive belt is slack around a portion of the agitator, such as a drive pulley on the agitator, and a driven pulley or other driven member connected to the drive shaft of the motor, and thus the agitator will not rotate. To engage the belt, a belt tightener or tensioner is pressed against the belt to take up any slack, thereby causing the agitator to rotate.

BRIEF DESCRIPTION OF THE INVENTION

A vacuum cleaner according to the invention comprises a base assembly having a housing, a suction nozzle and an agitator rotatably mounted to the housing, a motor having a motor shaft, a belt coupled between the agitator and the motor shaft, a belt tensioner comprising a pivot mount mounted to the housing, a first leg extending from the pivot mount, and a second leg extending from the pivot mount in a different direction than the first leg, and an actuator assembly comprising a cam assembly provided in register with the second leg, the cam assembly comprising a cam and a cam follower operably interconnected with the cam. The actuator assembly is movably mounted to the housing between a first position in which the cam follower is located in a raised position and a second position wherein the cam follower is located in a lowered position. Movement of the actuator assembly between the first and second positions selectively pivots the belt tensioner to place tension on the belt in the first position with the first leg and to allow slack in the belt in the second position by abutment of the cam assembly with the second leg.

DETAILED DESCRIPTION

The present invention relates generally to a side brush for the foot or base of a vacuum cleaner. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
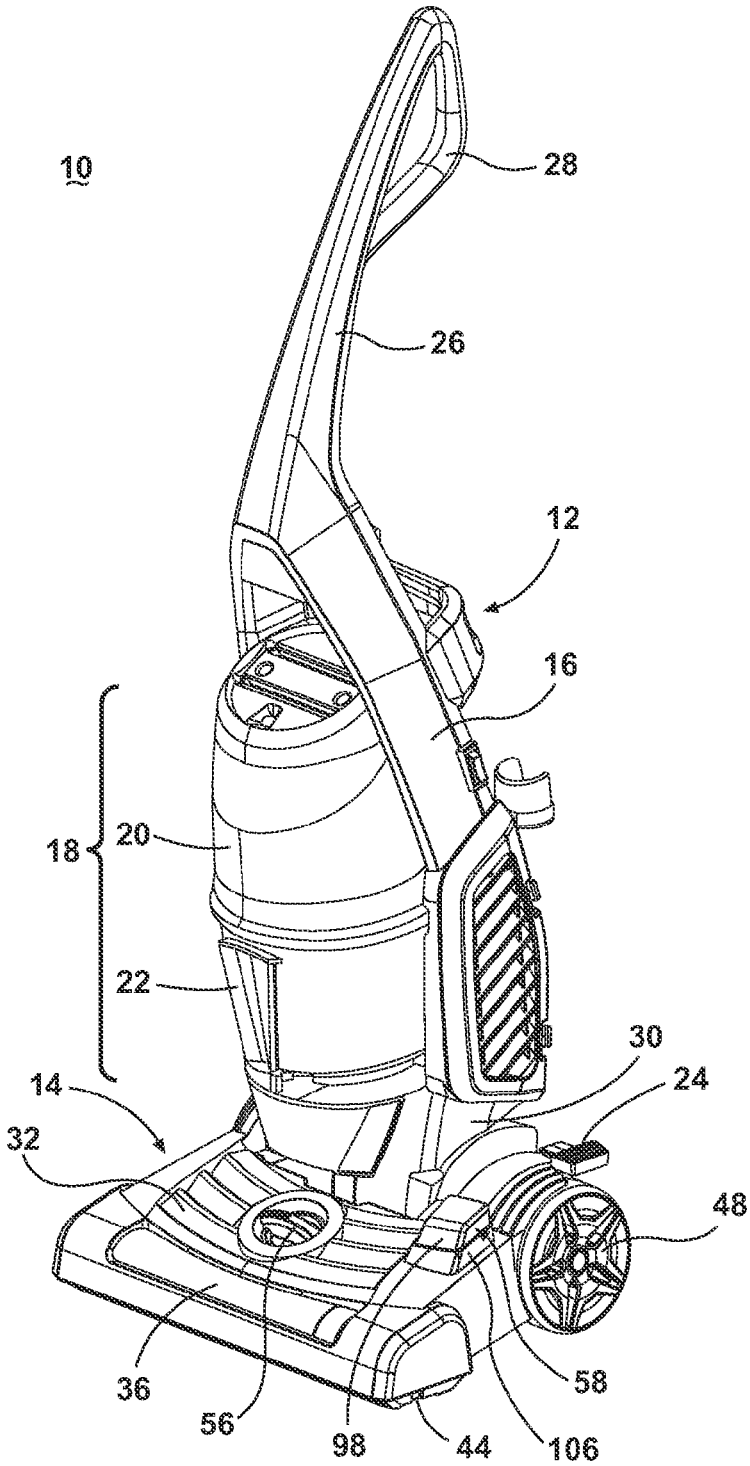
FIG. 1 is a front perspective view of a vacuum cleaner with base assembly pivotally attached to an upright handle assembly, with base assembly having a belt drive disengager according to a first embodiment of the invention.

FIG. 1 is a perspective view of a vacuum cleaner 10 according to a first embodiment of the invention. As illustrated, the vacuum cleaner 10 comprises an upright handle assembly 12 pivotally mounted to a base assembly 14. The upright handle assembly 12 generally comprises a main body 16 housing a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. In another conventional arrangement, the collection system 18 can include an integrally formed cyclone separator and dirt cup, with the dirt cup being provided with a bottom-opening dirt door for contaminant disposal. In yet another conventional arrangement, the collection system 18 can include a filter bag. The vacuum cleaner 10 can also be provided with one or more additional filters upstream or downstream of the collection system 18.

The upright handle assembly 12 is pivotally mounted to the base assembly 14 for movement between an upright storage position, shown in FIG. 1, and a reclined use position (not shown). The vacuum cleaner 10 can be provided with a detent mechanism, such as a pedal 24 pivotally mounted to the base assembly 14, for selectively releasing the upright handle assembly 12 from the storage position to the use position. The details of such a detent pedal 24 are commonly known in the art, and will not be discussed in further detail herein.

The main body 16 also has an upwardly extending handle 26 that is provided with a hand grip 28 at one end that can be used for maneuvering the vacuum cleaner 10 over a surface to be cleaned. A motor cavity 30 is formed at a lower end of the main body 16 and contains a conventional suction source (not shown), such as a motor/fan assembly, positioned therein in fluid communication with the collection system 18. In operation, the vacuum cleaner 10 draws in dirt-laden air through the base assembly 14 and into the collection system 18 where the dirt is substantially separated from the working air. The air flow then passes through the motor cavity 30 and past the suction source prior to being exhausted from the vacuum cleaner 10. A suitable upright handle assembly 12 is more fully described in detail in U.S. Pat. No. 7,708,789 to Fester, which is incorporated herein by reference in its entirety.

Figure 2:
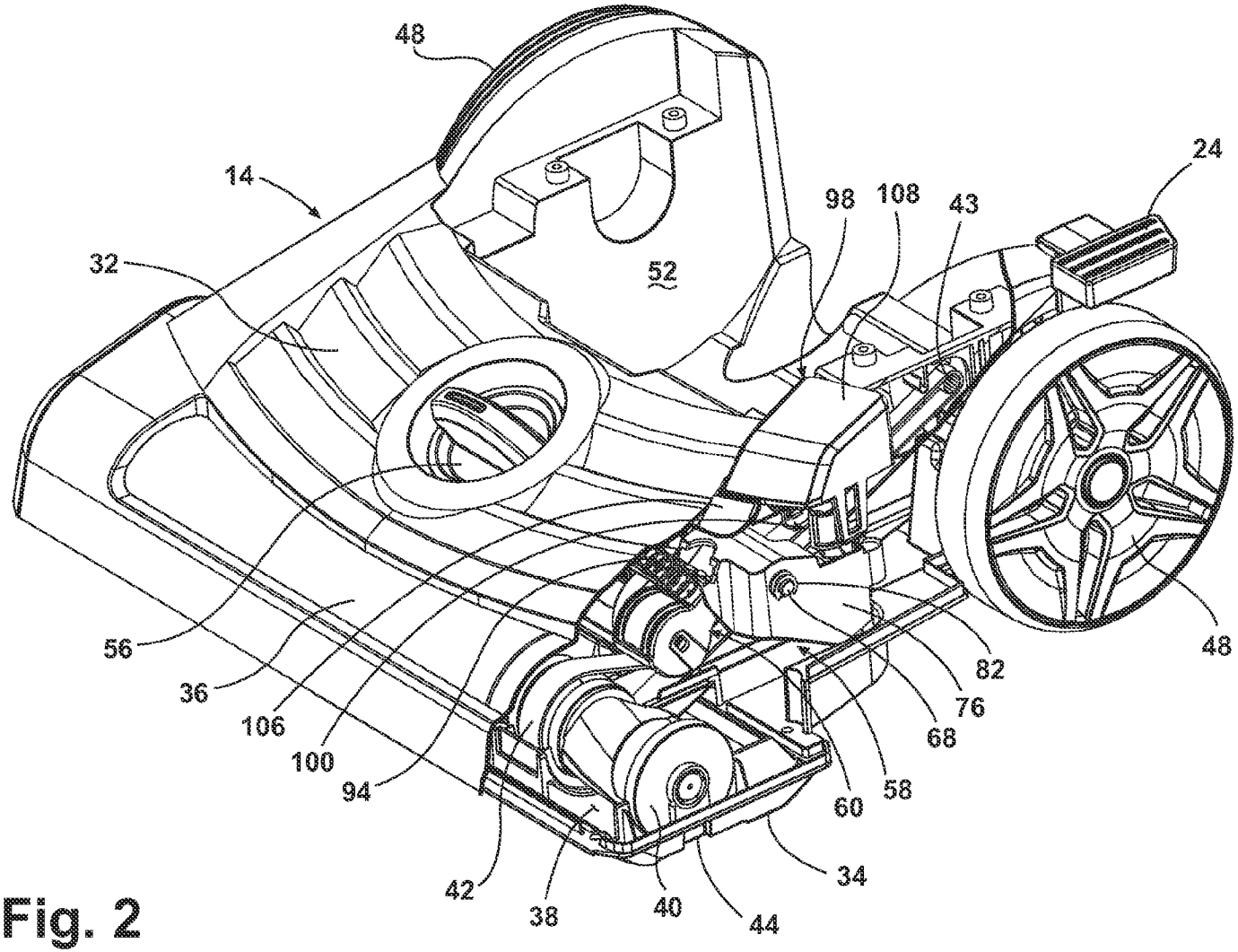
FIG. 2 is a partially cut-away perspective view of the base assembly from FIG. 1, with a portion of the base assembly cut away to illustrate the belt drive disengager from FIG. 1.

FIG. 2 is a partially cut-away perspective view of the base assembly 14 from FIG. 1. The base assembly 14 includes an upper housing 32 that couples with a lower housing 34 to create a partially enclosed space therebetween. As illustrated herein, the lower housing 34 can comprise a sole plate for the vacuum cleaner 10. An agitator casing 36 is positioned within the upper housing 32 and mates with a portion of the sole plate 34 to create an agitator chamber 38 at a forward portion of the upper housing 32. An agitator 40 is positioned within the agitator chamber 38 for rotational movement, and can be coupled to a shaft 43 of the motor/fan assembly in the motor cavity 30 (FIG. 1) via a drive belt 42. Alternatively, a dedicated agitator motor can be provided in the base assembly 14 for driving the agitator 40. The agitator 40 is illustrated as a rotatable brushroll; however, it is within the scope of the invention for other types of agitators to be used, such as a stationary brush or dual rotating brushrolls. The upper and lower housings 32, 34 and the agitator casing 36 can collectively be considered the housing of base assembly 14.

A suction nozzle opening 44 is formed in the lower housing 34 in fluid communication with the agitator chamber 38 and with the collection system 18 (FIG. 1) via suitable conduits or ducting as known in the art. A pair of wheels 48 are provided on the upper housing 32 for maneuvering the vacuum cleaner 10 over a surface to be cleaned. The upper housing 32 further includes a rear cavity 52 for receiving the motor cavity 30 of the upright handle assembly 12. Other common features of vacuum cleaner base assemblies, such as a suction nozzle height adjustment mechanism 56, can be provided.

The vacuum cleaner 10 further comprises a belt drive disengager 58 for selectively interrupting the transmission of drive force to the agitator 40. Specifically, the belt drive disengager 58 can be configured to selectively engage or place tension on the drive belt 42 to establish a drive connection between the shaft 43 and the agitator 40, and to selectively disengage or allow slack in the drive belt 42, which effectively breaks the drive connection between the shaft 43 and the agitator 40.

Figure 3:
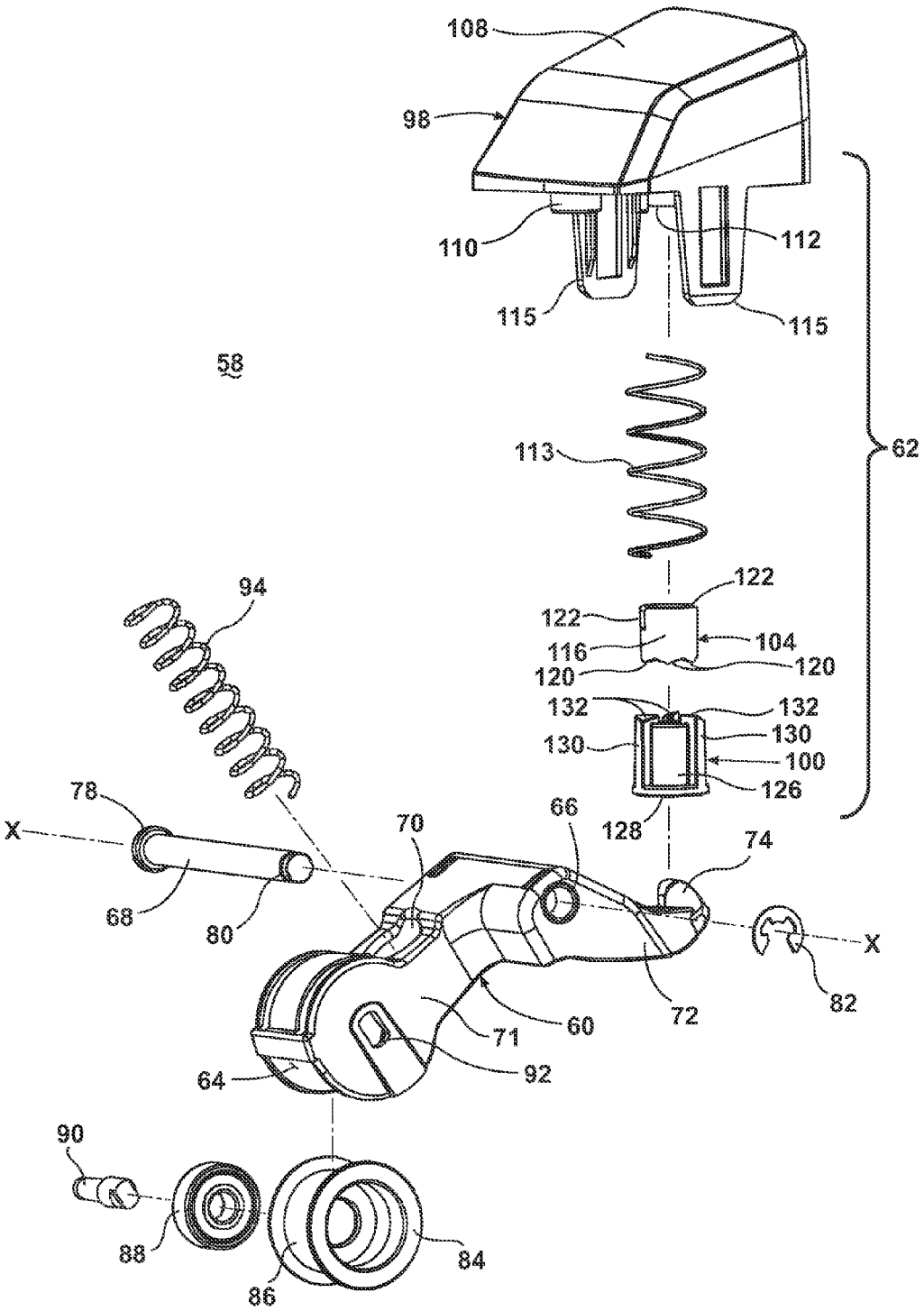
FIG. 3 is an exploded view of the belt drive disengager from FIG. 2.

With additional reference to FIG. 3, the belt drive disengager 58 comprises a tensioner arm 60 pivotally mounted to the base assembly 14 and an actuator assembly 62, which controls the position of the tensioner arm 60 relative to the base assembly 14 to selectively place tension on or allow slack in the drive belt 42. The tensioner arm 60 comprises a first leg 71 and a second leg 72 which are connected by a hub 66 that receives a pivot shaft 68 defining a rotational axis X of the tensioner arm 60. The first leg 71 includes a roller socket 64 at a distal end thereof and a pocket 70 formed on an upper surface of the first leg 71, between the roller socket 64 and the hub 66. The second leg 72 has an upstanding abutment finger 74.

The hub 66 can be aligned with a pivot socket 76 (FIG. 2) formed on a portion of the base assembly 14 such that the pivot shaft 68 extends through both the hub 66 and pivot socket 76. The pivot socket 76 can be formed on a portion of the agitator casing 36, but could alternately be formed on other portions of the base assembly 14, such as the upper or lower housings 32, 34. The pivot shaft 68 comprises a head 78 on one end thereof and a groove 80 on the other end thereof that receives a locking member 82, such as a C-shaped clamp, to secure the pivot shaft 68 to the tensioner arm 60 and base assembly 14.

The tensioner arm 60 carries a pulley or roller 84 having a belt-engaging surface 86 formed as a groove between two end walls of the roller 84. The roller 84 further comprises an inner bearing 88 carried on a roller shaft 90, one end of which is received within an opening 92 in the roller socket 64 to rotatably mount the roller 84 to the tensioner arm 60.

The tensioner arm 60 is normally biased away from the upper surface of the base housing 14, such as with a compressed coil spring 94 mounted between the tensioner arm 60 and a portion of the base housing 14, as shown in FIG. 2. One end of the coil spring 94 can be received within the pocket 70 on the tensioner arm 60, and the other end of the coil spring 94 can be received within a similar pocket (not shown) on the underside of the upper housing 32.

The first and second legs 71, 72 can extend in different directions from the hub 66. For example, as shown in the illustrated embodiment, the first and second legs 71, 72 can generally form an obtuse angle relative to each other, with the hub 66 or rotational axis X forming a vertex of the angle. In other embodiments, the first and second legs 71, 72 can form an acute angle relative to each other or be diametrically opposed with respect to the hub 66 or rotational axis X. It is understood that the first and second legs 71, 72 are not limited to extending in a substantially straight manner from the hub 66 or rotational axis X, but may themselves have angled or curved portions. For the purposes of the embodiment of the invention shown, the hub 66 and legs 71, 72 can be configured in any manner such that downward movement of second leg 72 results in upward movement of first leg 71, and vice versa. The effective lengths of the first and second legs 71, 72 can further be configured to provide the leverage or mechanical advantage needed to raise the roller 84 away from the belt 42 under force provided by the actuator assembly 62, described below. The effective length of the first leg 71 is the distance between the hub 66 or rotational axis X and the central axis of the roller 84, and the effective length of the second leg 72 is the distance between the hub 66 or rotational axis X and the abutment finger 74.

Figure 4:
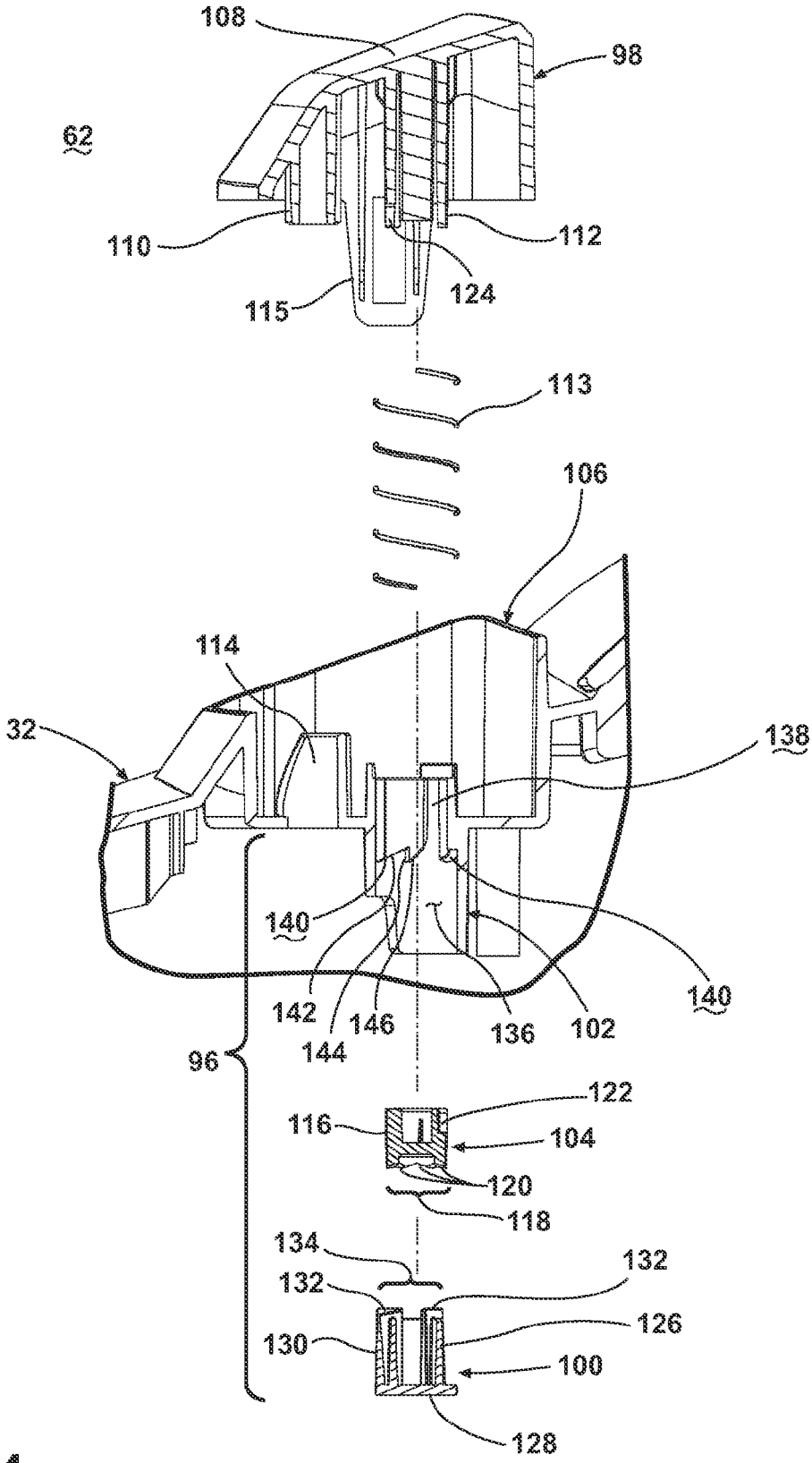
FIG. 4 is an exploded sectional view of an actuator assembly of the belt drive disengager from FIG. 2.

FIG. 4 is an exploded sectional view of the actuator assembly 62. The actuator assembly 62 can comprise a "push-push" ratchet mechanism 96, which controls the position of the tensioner arm 60, and a user-engagable actuator 98, shown herein as a pedal, which can be engaged by a foot of a user to actuate the ratchet mechanism 96. The ratchet mechanism 96 comprises a cam follower 100, a ratchet guide 102 for guiding the movement of the cam follower 100 in a controlled manner, and a cam 104 which transmits movement of the pedal 98 to the cam follower 100.

The pedal 98 is received within a pedal mount 106 provided within the upper housing 32 and comprises an upper engagement surface 108 which is provided exteriorly of the upper housing 32 such that it is visible to a user on the upper surface of the upper housing 32. A front post 110 and a rear post 112 extend downwardly from the upper engagement surface 108. The pedal 98 is normally biased away from the upper surface of the upper housing 32 by coil spring 113 that is mounted between an underside of the pedal 98 and the bottom surface of the pedal mount 106, and received around the rear post 112. The pedal 98 further has a pair of stems 115 depending from the upper engagement surface 108, laterally to the posts 110, 112.

Figure 5:
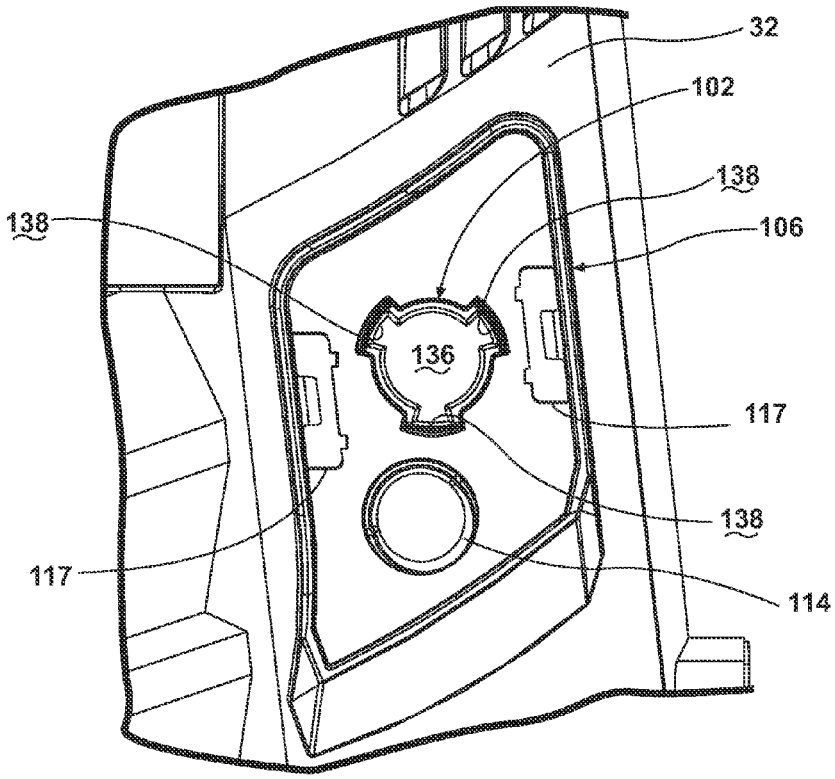
FIG. 5 is a close-up, top view of a housing of the base assembly, illustrating a portion of the belt drive disengager from FIG. 2.
Figure 6:
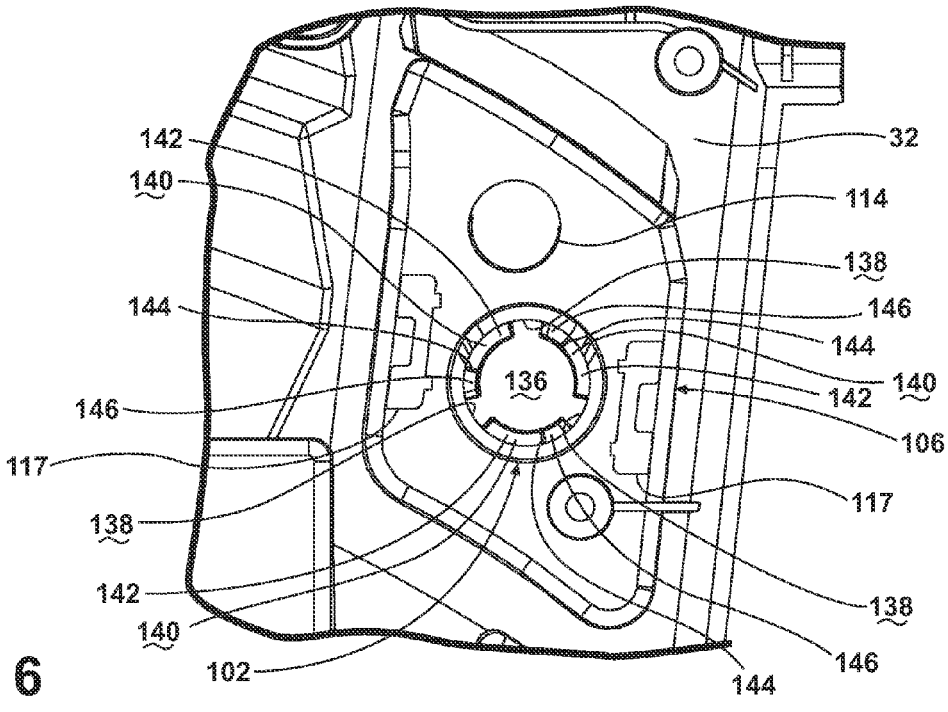
FIG. 6 is a close-up, bottom view of a housing of the base assembly, illustrating a portion of the belt drive disengager from FIG. 2.

With additional reference to FIGS. 5 and 6, which are close-up, top and bottom views, respectively of the upper housing 32, the pedal mount comprises a cylindrical flange 114 for receiving the front post 110 of the pedal 98 and a pair of slots 117 for receiving the stems 115 of the pedal 98, both of which contribute to guiding the vertical displacement of the pedal 98 and preventing non-vertical displacement of the pedal 98 relative to the pedal mount 106 and further prevents binding of the assembly during use.

Referring back to FIG. 4, the cam 104 comprises a cylindrical body 116 having a lower cammed surface 118 with a crown-like profile, which comprises a plurality of wedges 120. Other profile shapes for the cammed surface 118 are possible. The cam 104 is received and engaged by the rear post 112 of the pedal 98. The cam 104 can be keyed to the pedal 98 to prevent rotation of the cam 104 relative to the pedal 98. As shown herein, the top end portion of the cam 104 has cut-out profile 122 that coincides with a corresponding profile 124 on the rear post 112 of the pedal 98.

The cam follower 100 comprises a cylindrical body 126 having a lower surface 128 and multiple fin-shaped projections 130 extending along and slightly upwardly of the cylindrical body 126. As shown herein, three circumferentially spaced fin-shaped projections 130 are provided on the cylindrical body 126. The fin-shaped projections 130 have angled upper surfaces 132 that form a cam follower surface 134 configured to engage and follow the cammed surface 118 of the cam 104, with the wedges 120 engaging the angled upper surfaces 132.

With reference to FIGS. 4-6, the ratchet guide 102 is integrally formed with the upper housing 32 and located within the pedal mount 106, to the rear of the cylindrical flange 114. Alternatively, while not shown herein, the ratchet guide 102 can be formed as a separate piece from the upper housing 32. The ratchet guide 102 comprises a cylindrical opening 136 which at least partially receives the cam follower 100 and the cam 104. The interior surface defining the opening 136 has a sequential series of deep grooves 138 and shallow grooves 140 circumferentially spaced about the interior surface. The deep and shallow grooves 138, 140 alternately receive the fin-shaped projections 130 of the cam follower 100. As shown best in FIGS. 5-6, three deep grooves 138 and three shallow grooves 140 are provided, corresponding in number to the three fin-shaped projections 130. The deep grooves 138 are deeper or longer than the shallow grooves 140. For example, in the illustrated embodiment, the deep grooves 138 can extend to the top of the ratchet guide 102, while the shallow grooves 140 do not extend to the top of the ratchet guide 102. The shallow grooves 140 are defined by an inclined surface 142 and a longitudinal surface 144. An angled transition surface 146 extends between the longitudinal surface 144 of each shallow groove 140 and one of the adjacent deep grooves 138 and guides the movement of the fin-shaped projections 130 from the shallow grooves 140 to the deep grooves 138.

Figure 7:
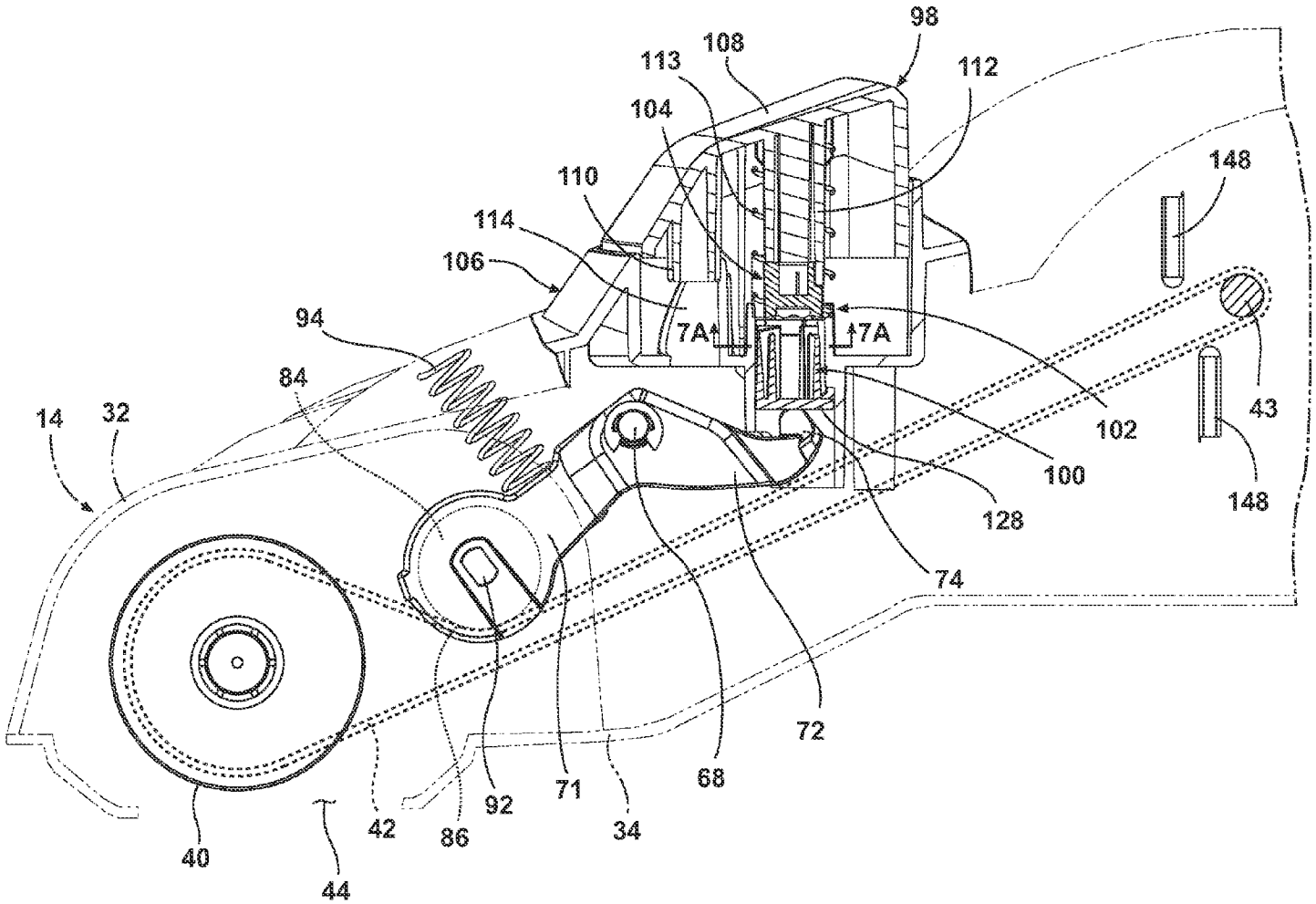
FIG. 7 is a side schematic view of the belt drive disengager from FIG. 2 in an engaged position in which drive force is transmitted to an agitator.
Figure 7A:
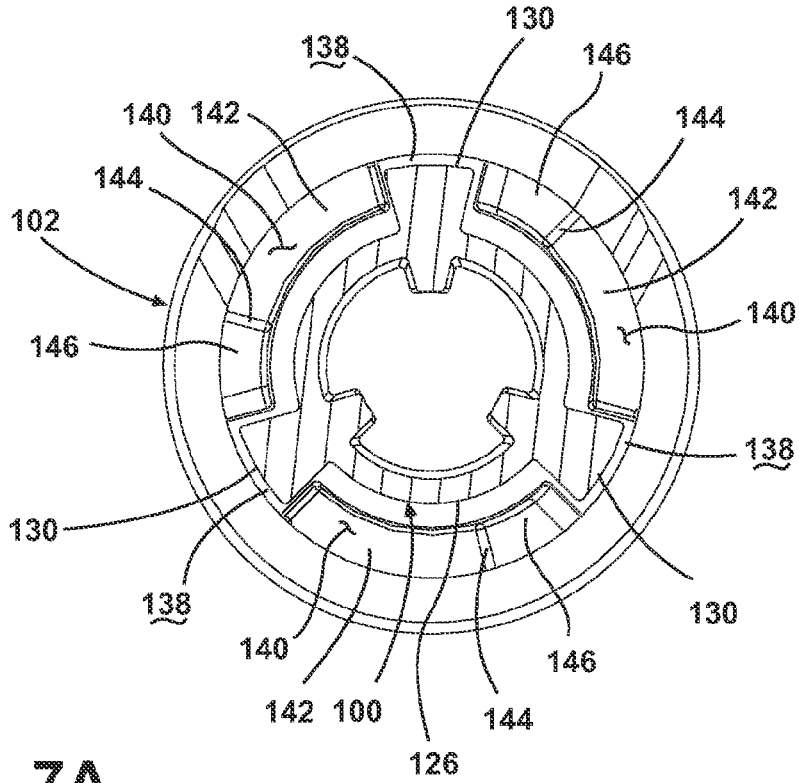
FIG. 7A is a sectional view taken through line 7A-7A of FIG. 7.
Figure 8A:
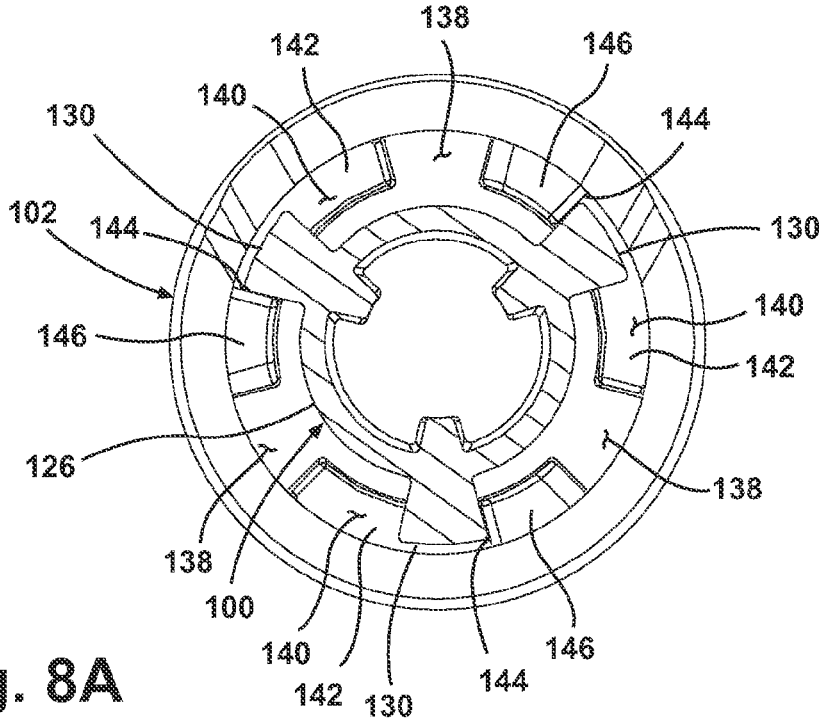
FIG. 8A is a sectional view taken through line 8A-8A of FIG. 8.
Figure 8:
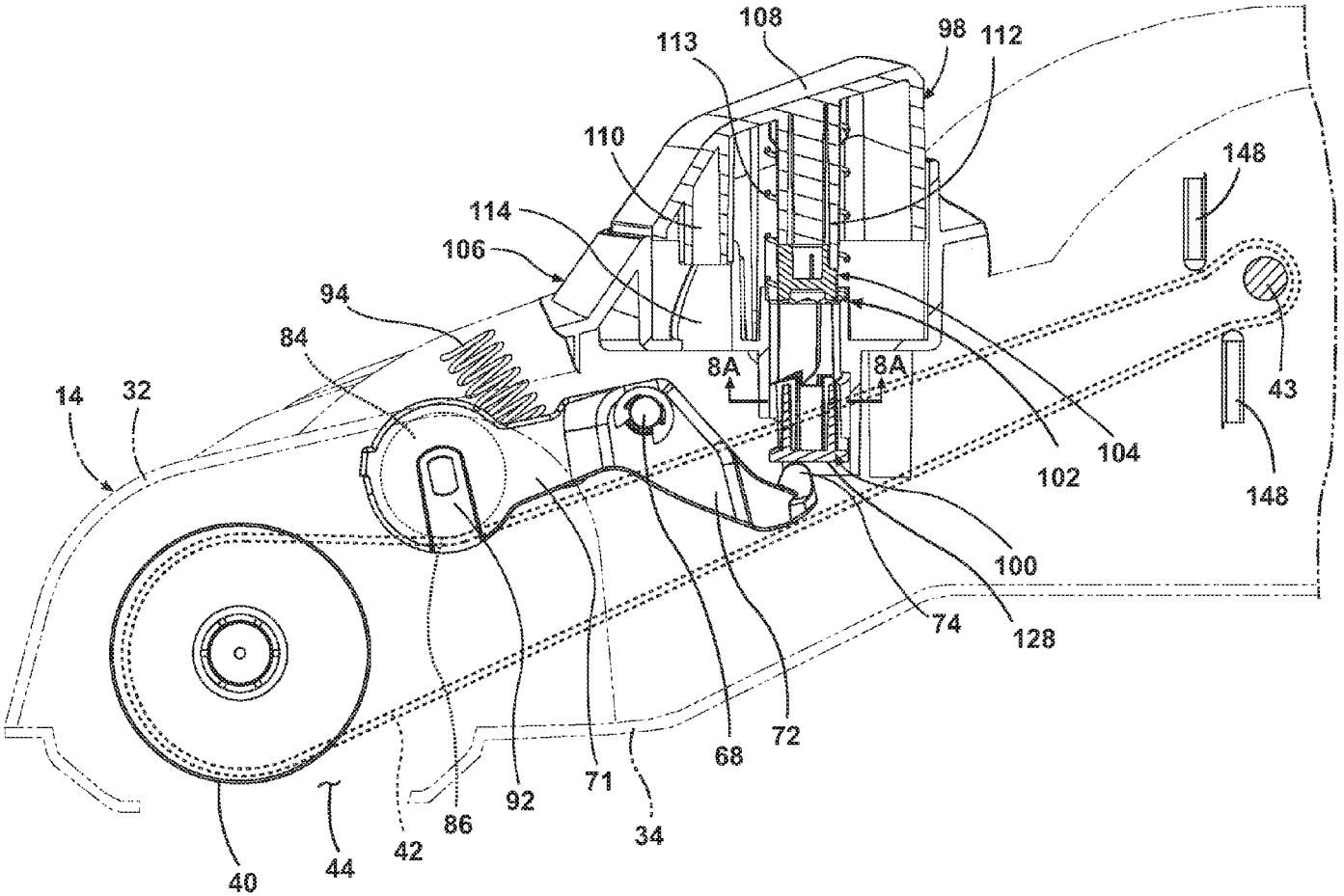
FIG. 8 is a side schematic view of the belt drive disengager from FIG. 2 in a disengaged position in which drive force is not transmitted to an agitator.

FIGS. 7-8A illustrate the operation of the belt drive disengager 58. FIG. 7 is a side schematic view of the belt drive disengager 58 in an engaged position in which drive force is transmitted to the agitator 40. In operation, when a user depresses the pedal 98, the cam 104 is displaced downwardly due to its attachment to the pedal 98. The displaced cam 104 engages the cam follower 100 and the cam follower 100 is pushed downwardly past the grooves 138, 140 of the ratchet guide 102. At the same time, the cam follower 100 is rotated by engagement of the cam follower surface 134 with the cammed surface 118 on the cam 104. As a result, the cam follower 100 rotates within the ratchet guide 102 while simultaneously moving downwardly. The distance that the cam follower 100 rotates can correspond to the distance between adjacent grooves 138, 140. Accordingly, upon release of the pedal 98, the fin-shaped projections 130 of the cam follower 100 are received in the deep grooves 138, as shown in FIG. 7A, a sectional view taken through line 7A-7A of FIG. 7. In this position, the cam follower 100 is free to move upwardly within the ratchet guide 102 within the deep grooves 138, and the lower surface 128 of the cam follower 100 does not assert a displacement force against the abutment finger 74 on the second leg 72 tensioner arm 60. Thus, the coil spring 94 biases the tensioner arm 60 in a counterclockwise direction about the pivot shaft 68 (when viewed from the perspective of FIG. 7) and the roller 84 engages the drive belt 42 and places a sufficient amount of tension on the drive belt 42 to establish a drive connection between the shaft 43 and the agitator 40.

FIG. 8 is a side schematic view of the belt drive disengager from FIG. 2 in a disengaged position in which drive force is not transmitted to the agitator. When a user depresses the pedal 98 a subsequent time, the cam follower 100 again rotates within the ratchet guide 102 while simultaneously moving downwardly due to the engagement of the displaced cam 104. Accordingly, upon release of the pedal 98, the fin-shaped projections 130 of the cam follower 100 are received in the shallow grooves 140, as shown in FIG. 8A, which is a sectional view taken through line 8A-8A of FIG. 8. In this position, the upward movement of the cam follower 100 within the ratchet guide 102 is limited by the corner of the shallow groove 140 created by the inclined and lateral surfaces 142, 144. The lower surface 128 of the cam follower 100 asserts a displacement force against the abutment finger 74 on the second leg 72 tensioner arm 60 that is sufficient to overcome the opposing force of the coil spring 94 to rotate the tensioner arm 60 in a clockwise direction about the pivot shaft 68 (when viewed from the perspective of FIG. 8). The roller 84 is lifted away from the drive belt 42 and the drive belt 42 slackens, which effectively breaks the drive connection between the shaft 43 and the agitator 40. The roller 84 may still engage the drive belt 42 in this position, but does not place a significant amount of tension on the drive belt 42. A pair of opposing pins 148 can be provided in the base assembly 14, near the motor shaft 43, and can be positioned to frictionally retain the drive belt 42 to prevent spinning of the drive belt 42 when the drive belt is disengaged, as shown in FIG. 8. Without the pins 148, the spinning motor shaft 43 has a tendency to engage the drive belt 42, which would result in undesired agitator rotation even when the belt drive disengager is in the disengaged position.

The belt drive disengager 58 is actuated via a "push-push" mechanism, i.e. a first push of the pedal 98 can move the belt drive disengager 58 the engaged position shown in FIG. 7 while a second push of the pedal 98 can move the belt drive disengager 58 the disengaged position shown in FIG. 8. As the user sequentially pushes the pedal 98, the deep and shallow grooves 138, 140 inside the ratchet guide 102 alternately receive the fin-shaped projections 130 as the cam follower 100 rotates when the cammed surface 118 on the cam 104 engages the cam follower surface 134. Specifically, with reference to FIGS. 4, 7A, and 8A, starting with the fin-shaped projections 130 received in the shallow grooves 140, i.e. with the belt drive disengager 58 in the disengaged position, a first push of the pedal 98, and subsequent rotational and vertical engagement between the cammed surface 118 and cam follower surface 134, causes the angled upper surfaces 132 of the fin-shaped projections 130 to drop below the transition surfaces 146 as the fin-shaped projections 130 are rotated into alignment with the deep grooves 138. The fin-shaped projections 130 may not be in perfect alignment with the deep grooves 138, however, the angled transition surfaces 146 ensures that the projections 130 are guided towards the deep grooves 138. Upon release of the pedal 98, the force from the coil spring 94 drives the cam follower 100 upwardly along the transition surfaces 146 and into the deep grooves 138 via the mechanical link provided by the tensioner arm 60.

A second push of the pedal 98, and subsequent rotational and vertical engagement between the cammed surface 118 and cam follower surface 134, causes the angled upper surfaces 132 of the fin-shaped projections 130 to drop below the inclined surface 142 of the shallow groove 140 as the fin-shaped projections 130 are rotated into alignment with the shallow groove 140. Upon release of the pedal 98, the force from the coil spring 94 drives the cam follower 100 upwardly via the tensioner arm 60, but the upward movement of the cam follower 100 is limited by the corner of the shallow groove 140 created by the inclined and lateral surfaces 142, 144.

The belt drive disengager 58 offers several benefits over the prior art. The belt drive disengager 58 can be produced at a lower cost and includes less component pieces compared to previous designs, including clutch designs or other single motor brush disengager designs which use elaborate linkages and require intricate stamped metal parts. The push-push configuration of the actuator assembly 62 is also more robust and functionally reliable compared to prior art designs. For example, prior art designs have used a torsion spring with a bent end that follows a track and selectively catches on a detent feature. This torsion spring configuration is not reliable because the bent end of the torsion spring can frequently skip over the detent/catch feature. Additionally, the ends of the torsion spring can become bent or deformed during operation, thereby degrading the performance and reliability even more. The embodiment of the invention shown herein uses a cam follower 100 which is not subject to deformation during use, and which reliably follows the cam 104 during operation. The push-push design of the actuator assembly 62 and pedal 98 further requires less space on the surface of the base assembly 14 than previous rocker-type, pivoting pedal designs, and can also be easier for a user to depress due to its more ergonomic positioning.

Figure 9:
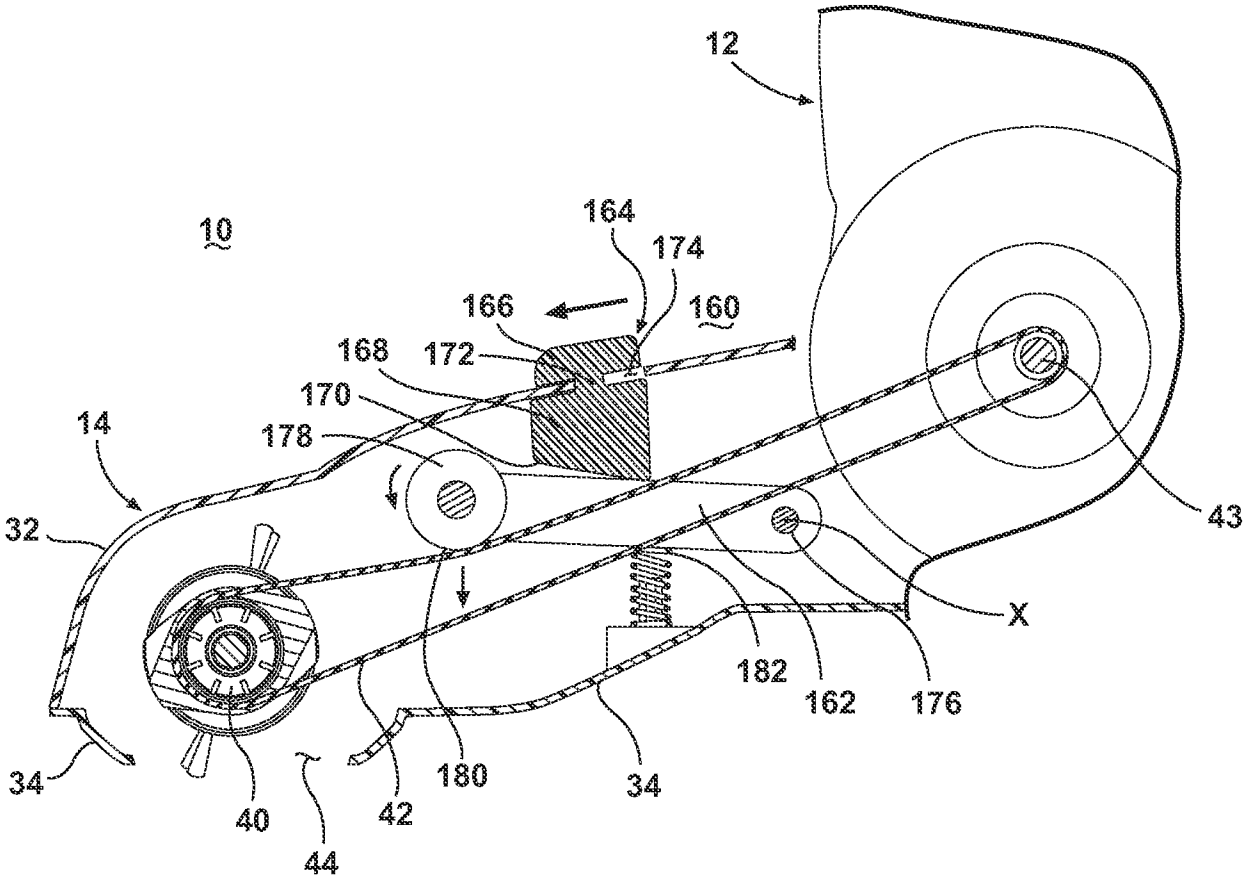
FIG. 9 is a side schematic view of a vacuum cleaner having a belt drive disengager according to a second embodiment of the invention, illustrating the belt drive disengager in an engaged position in which drive force is transmitted to an agitator.
Figure 10:
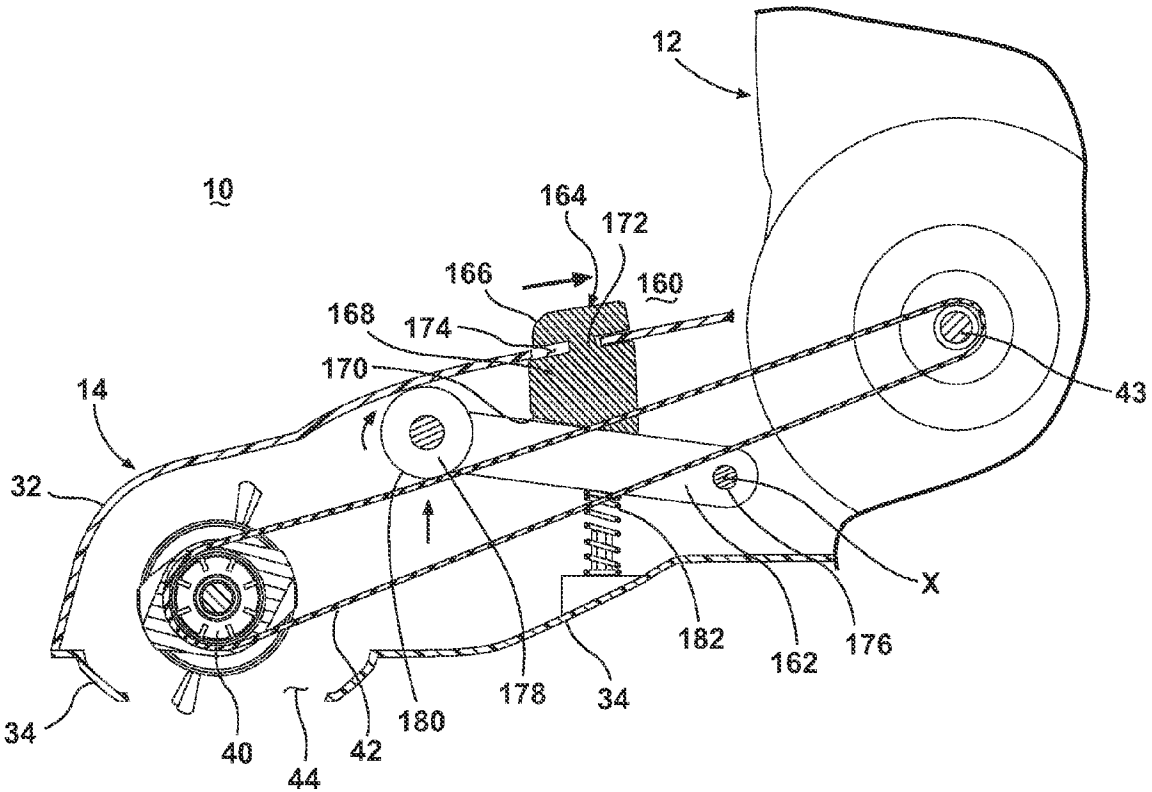
FIG. 10 is a side schematic view of the vacuum cleaner from FIG. 9, illustrating the belt drive disengager in a disengaged position in which drive force is not transmitted to the agitator.

FIGS. 9-10 are schematic views of a vacuum cleaner 10 having a belt drive disengager 160 according to a second embodiment of the invention. The second embodiment of the belt drive disengager 160 can be implemented in a vacuum cleaner 10 having substantially the same elements as described above for the first embodiment, such as, among other elements, the upright handle assembly 12 pivotally mounted to the base assembly 14 having the agitator 40 driven by the drive belt 42 coupled to the shaft 43 of a motor in the upright handle assembly 12. It is understood that, while they may not be illustrated in the drawings, the vacuum cleaner 10 can include any of the features described above for the first embodiment.

The belt drive disengager 160 comprises a tensioner arm 162 pivotally mounted to the base assembly 14 and an actuator assembly 164 which controls the position of the tensioner arm 162 relative to the base assembly 14 to selectively release tension on the drive belt 42, which disengages the drive belt 42 to cease driving the agitator 40, and to selectively place tension on or remove slack from the drive belt 42, which engages the drive belt 42 to drive the agitator 40.

The actuator assembly 164 comprises a pedal 166 that is operably connected to a wedge 168 having a lower surface with an inclined profile 170. The pedal 166 can be configured to be actuated by the foot of a user, but may also be actuated by the hand of a user. As shown herein, the pedal 166 and wedge 168 are directly connected by a neck portion 172 extending between a lower surface of the pedal 166 and an upper surface of the wedge 168. Other direct and indirect connections between the pedal 166 and wedge 168 are possible. The neck portion 172 is slidably mounted in a track 174 on the base assembly 14, with the pedal 166 exterior of the base assembly 14 and the wedge 168 received within the base assembly 14 and in register with the tensioner arm 162. The track 174 can be provided in an upper surface of the upper housing 32, and can extend linearly, such that movement of the actuator assembly 162 is limited to linear forward and backward movement.

The tensioner arm 162 comprises a pivot shaft 176 at one end thereof defining a rotational axis X for the tensioner arm 162. The tensioner arm 162 is pivotally mounted to the housing of the base assembly 14 by the pivot shaft 176, and can, but is not limited to, be mounted in the same manner as disclosed in the first embodiment. The tensioner arm 162 carries a pulley or roller 178 having a belt-engaging surface 180. The roller 178 can be pivotally mounted in spaced relation to the pivot shaft 176, such as at a distal end of the tensioner arm 162 for rotational movement relative to the tensioner arm 162. The belt-engaging surface 180 of the roller 178 can be configured to selectively bear down on the drive belt 42 to remove the slack and increase belt tension between the shaft 43 and the agitator 40. A coil spring 182 is compressed between the underside of the tensioner arm 162 and a lower portion of the base assembly 14, such as the lower housing 34 or another portion of the base assembly 14, and normally biases the tensioner arm 162 upwardly and away from the drive belt 42.

In operation, a user can selectively slide the pedal 166 forward and backward within the track 174 to engage and disengage the drive belt 42, respectively. Referring to FIG. 9, to engage the drive belt 42 and operably connect the motor shaft 43 to the agitator 40, a user slides the pedal 166 forwardly in the track 174. The wedge 168 engages the tensioner arm 162 and the inclined profile 170 forces the tensioner arm 162 downwardly, which compresses the coil spring 182. The belt-engaging surface 180 of the roller 178 bears down on the drive belt 42 and forces a section of the drive belt 42 downwardly, thus removing slack from the drive belt 42 and operably connecting the motor shaft 43 to the agitator 40 via the taut or tensioned drive belt 42.

Referring to FIG. 10, to disengage the drive belt 42, the user slides the pedal 166 rearwardly in the track 174, whereupon the wedge 168 slides away from the end of the tensioner arm 162 carrying the roller 178. The compressed coil spring 182 forces the tensioner arm 162 to rotate about the axis X defined by the pivot shaft 176, allowing the end of the tensioner arm 162 carrying the roller 178 to rise upwardly along the inclined profile 170 of the wedge 168. The roller 178 moves away from the drive belt 42, which removes tension from or creates slack in the drive belt 42 and disengages the motor shaft 43 from the agitator 40.

The second embodiment of the belt drive disengager 160 utilizing the sliding pedal 166 and wedge 168 offers a simple mechanism for actuating the tensioner arm 162 with a reduced number of component parts. The belt drive disengager 160 may therefore be less expensive to manufacture and may operate more reliably than other prior art designs.

Figure 11:
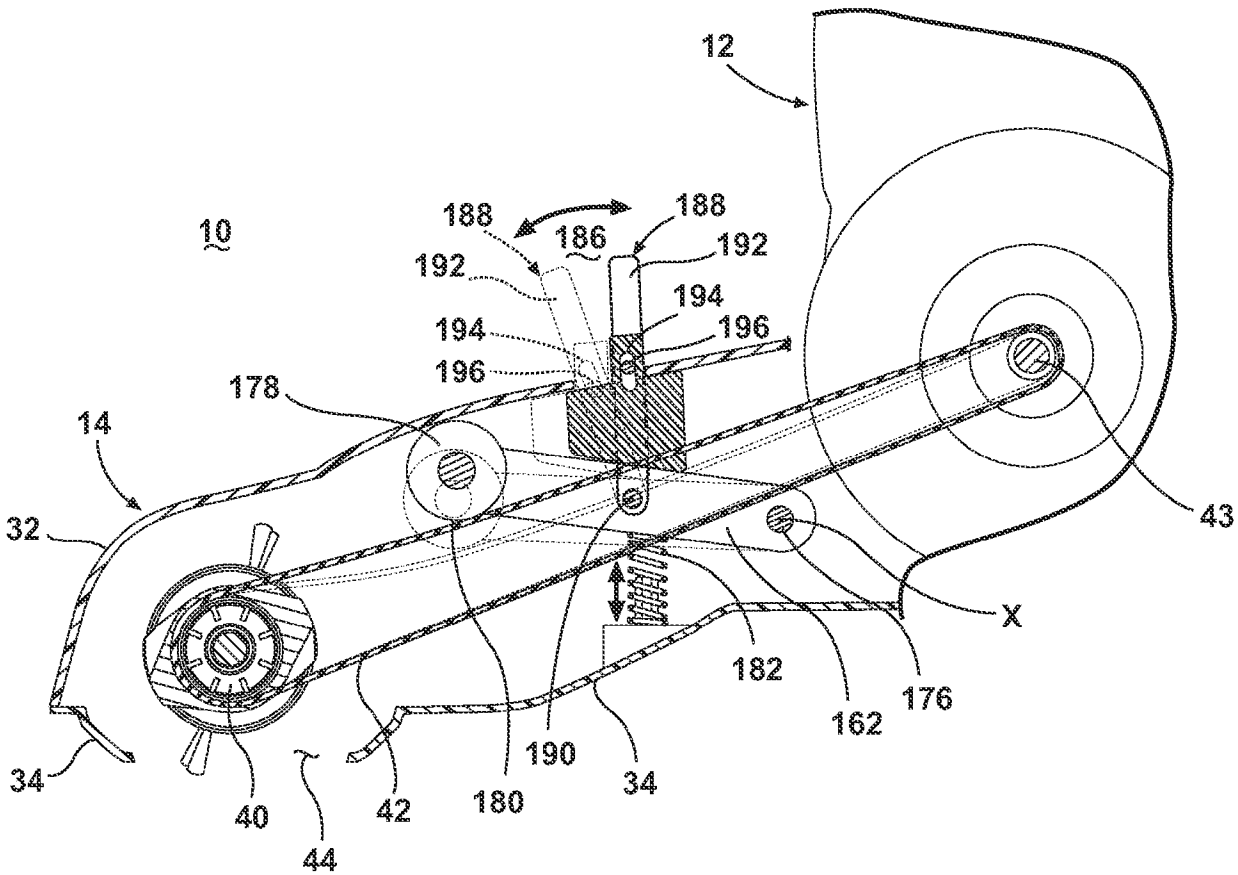
FIG. 11 is a side schematic view of a vacuum cleaner having a belt drive disengager according to a third embodiment of the invention.

FIG. 11 is a schematic view of a vacuum cleaner 10 having a belt drive disengager 186 according to a third embodiment of the invention. The third embodiment of the belt drive disengager 186 can be implemented in a vacuum cleaner 10 having substantially the same elements as described above for the first embodiment, such as, among other elements, the upright handle assembly 12 pivotally mounted to the base assembly 14 having the agitator 40 driven by the drive belt 42 coupled to the shaft 43 of a motor in the upright handle assembly 12. It is understood that, while they may not be illustrated in the drawings, the vacuum cleaner 10 can include any of the features described above for the first embodiment.

The belt drive disengager 186 further can be substantially similar to the second embodiment of the belt drive disengager 160 shown in FIGS. 9-10, with the exception that the actuator assembly 164 comprises a lever 188 operably connected to the wedge 168 in place of a pedal to provide a larger mechanical advantage to the user. The lever 188 can be configured to be actuated by the foot and/or hand of a user.

The lever 188 can be pivotally connected to the tensioner arm 162 at one end by a pivot 190, and can extend through the track 174 to a free upper end which forms a user-engagable portion 192 which the user can utilize to operate the lever 188. The track 174 limits movement of the lever 188 to rotation along a linear forward and backward direction.

The lever 188 can further be linked to the wedge 168, such that rotation of the lever 188 within the track 174 results in a sliding movement of the wedge 168 relative to the tensioner arm 162. As shown, the lever 188 can have an elongated slot 194 which slidingly receives a pin 196 on the wedge 168.

In operation, a user can selectively pivot the lever 188 forward and backward within the track 174 to engage and disengage the drive belt 42, respectively. To engage the drive belt 42 and operably connect the motor shaft 43 to the agitator 40, a user pivots the lever 188 forwardly in the track 174, which is accompanied by forward movement of the wedge 168 due to the linkage provided by the slot 194 and pin 196. The wedge 168 engages the tensioner arm 162 and the inclined profile 170 forces the tensioner arm 162 downwardly, which compresses the coil spring 182. The belt-engaging surface 180 of the roller 178 bears down on the drive belt 42 and forces a section of the drive belt 42 downwardly, thus removing slack from the drive belt 42 and operably connecting the motor shaft 43 to the agitator 40 via the taut or tensioned drive belt 42. To disengage the drive belt 42, the user pivots the lever 188 rearwardly in the track 174, whereupon the wedge 168 slides away from the end of the tensioner arm 162 carrying the roller 178. The compressed coil spring 182 forces the tensioner arm 162 to rotate about the axis X defined by the pivot shaft 176, allowing the end of the tensioner arm 162 carrying the roller 178 to rise upwardly along the inclined profile 170 of the wedge 168. The roller 178 moves away from the drive belt 42, which removes tension from or creates slack in the drive belt 42 and disengages the motor shaft 43 from the agitator 40.

The third embodiment of the belt drive disengager 186 utilizing the lever 188 may increases a user's mechanical advantage over the second embodiment of the belt drive disengager 160 utilizing the sliding pedal 166, which may ultimately improve the ease of using the belt drive disengager 186. Furthermore, the lever 188 can be positioned in a variety of locations across the width of the base assembly 14 by simply increasing the length of the pin 196 that connects the lever 188 to the wedge 168. This flexibility permits the lever 188 to be mounted near the upright handle assembly 12, which offers the possibility of using the upright handle assembly 12 to automatically engage the lever 188 and thereby disengage/engage the belt drive disengager 186 when the upright handle assembly 12 is pivoted between an upright storage position, shown in FIG. 1, and a reclined use position (not shown).

Figure 12:
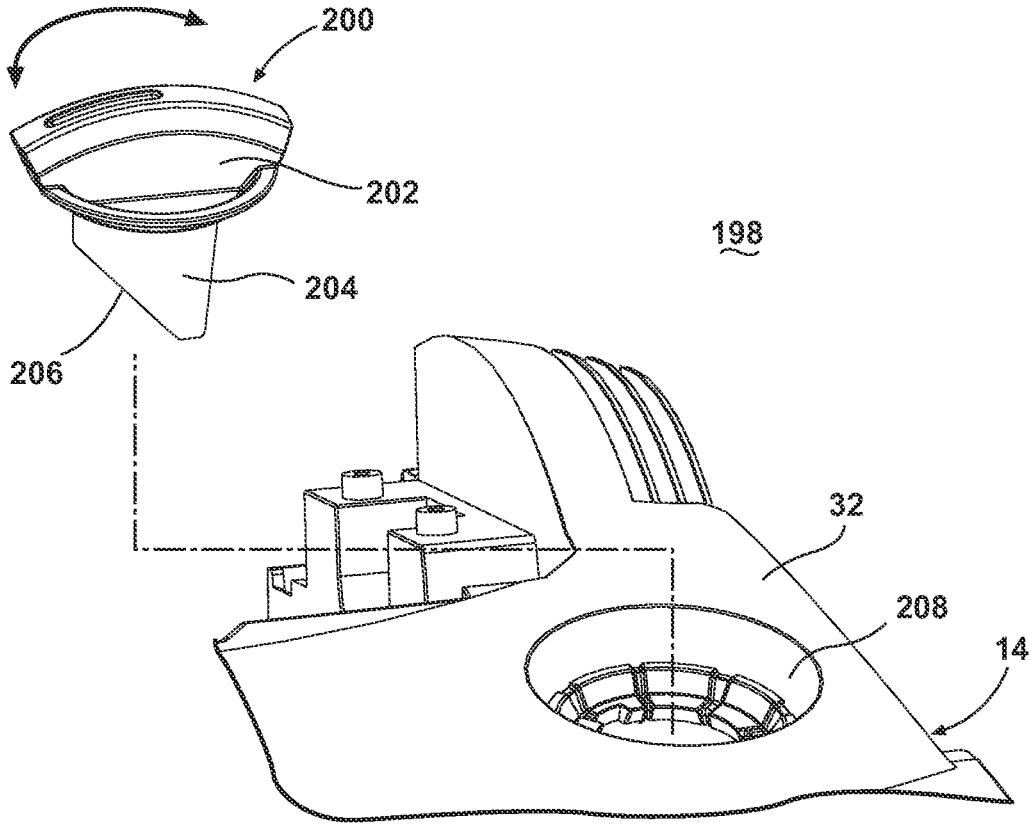
FIG. 12 is a partially exploded perspective view of a vacuum cleaner having a belt drive disengager according to a fourth embodiment of the invention.

FIG. 12 is a partially exploded perspective view of a vacuum cleaner having a belt drive disengager 198 according to a fourth embodiment of the invention. The fourth embodiment of the belt drive disengager 198 can be implemented in a vacuum cleaner 10 having substantially the same elements as described above for the first embodiment, such as, among other elements, the upright handle assembly 12 pivotally mounted to the base assembly 14 having the agitator 40 driven by the drive belt 42 coupled to the shaft 43 of a motor in the upright handle assembly 12. It is understood that, while they may not be illustrated in the drawings, the vacuum cleaner 10 can include any of the features described above for the first embodiment.

The belt drive disengager 198 further can be substantially similar to the second embodiment of the belt drive disengager 160 shown in FIGS. 9-10, with the exception that an actuator assembly 200 comprises a rotary dial 202 operably connected to a wedge 204 having a lower surface with a helically ramped profile 206. The dial 202 can be configured to be actuated by the hand of a user. The fourth embodiment of the belt drive disengager 198 utilizing the rotary dial 202 may require less space within the base assembly 14 than the second and third embodiments of the belt drive disengager 160, 186 utilizing the sliding wedge 168, and may ultimately result in a more compact base assembly 14.

The actuator assembly 164 is rotatably mounted in an opening 208 in the base assembly 14, with the dial 202 exterior of the base assembly 14 and the wedge 204 received within the base assembly 14 and in register with the tensioner arm 162. The opening 208 can be provided in an upper surface of the upper housing 32.

Figure 13:
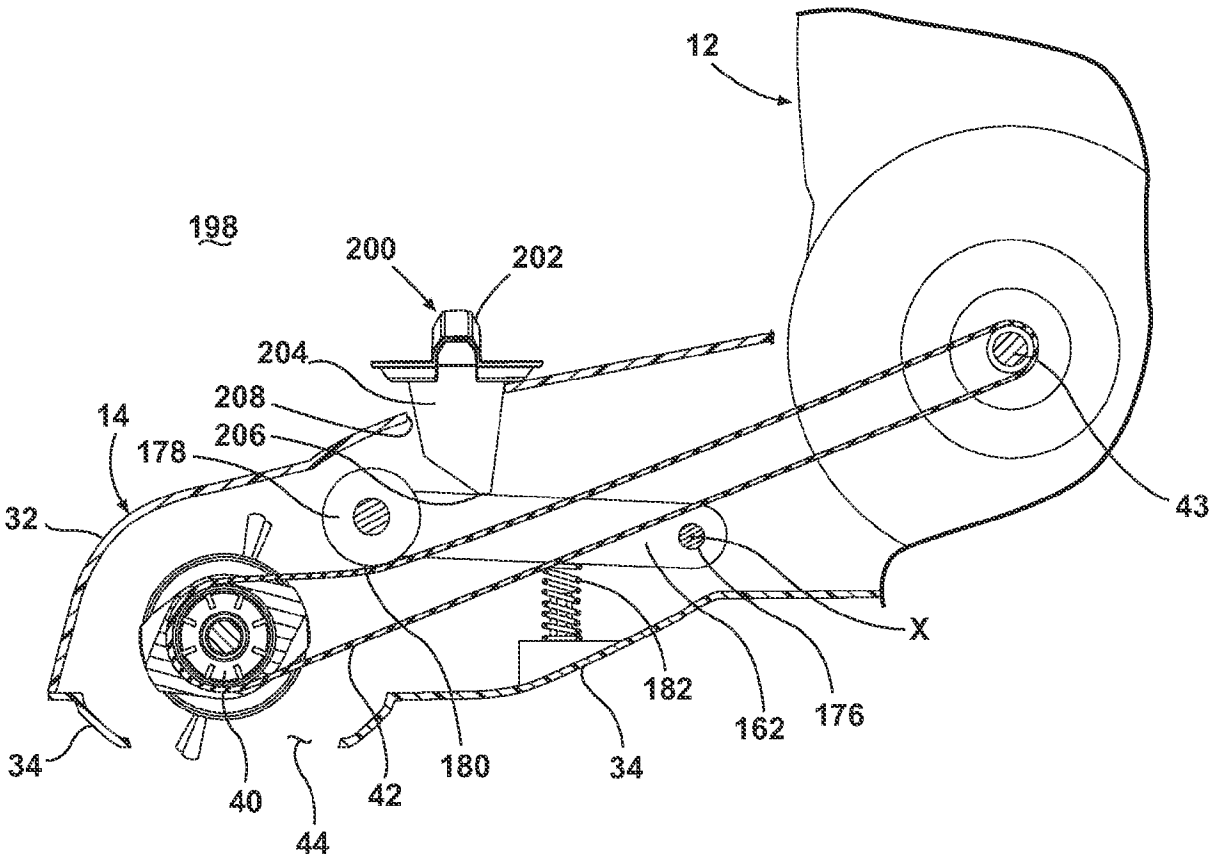
FIG. 13 is a side schematic view of the belt drive disengager from FIG. 12 in an engaged position in which drive force is transmitted to an agitator.

In operation, a user can selectively rotate the dial 202 within the opening 208 to engage and disengage the drive belt 42, respectively. Referring to FIG. 13, to engage the drive belt 42 and operably connect the motor shaft 43 to the agitator 40, a user rotates the dial 202 relative to the opening 208 in a first direction. The wedge 204 engages the tensioner arm 162 and the increasing height of the helically ramped profile 206 forces the tensioner arm 162 downwardly, which compresses the coil spring 182. The belt-engaging surface 180 of the roller 178 bears down on the drive belt 42 and forces a section of the drive belt 42 downwardly, thus removing slack from the drive belt 42 and operably connecting the motor shaft 43 to the agitator 40 via the taut or tensioned drive belt 42.

Figure 14:
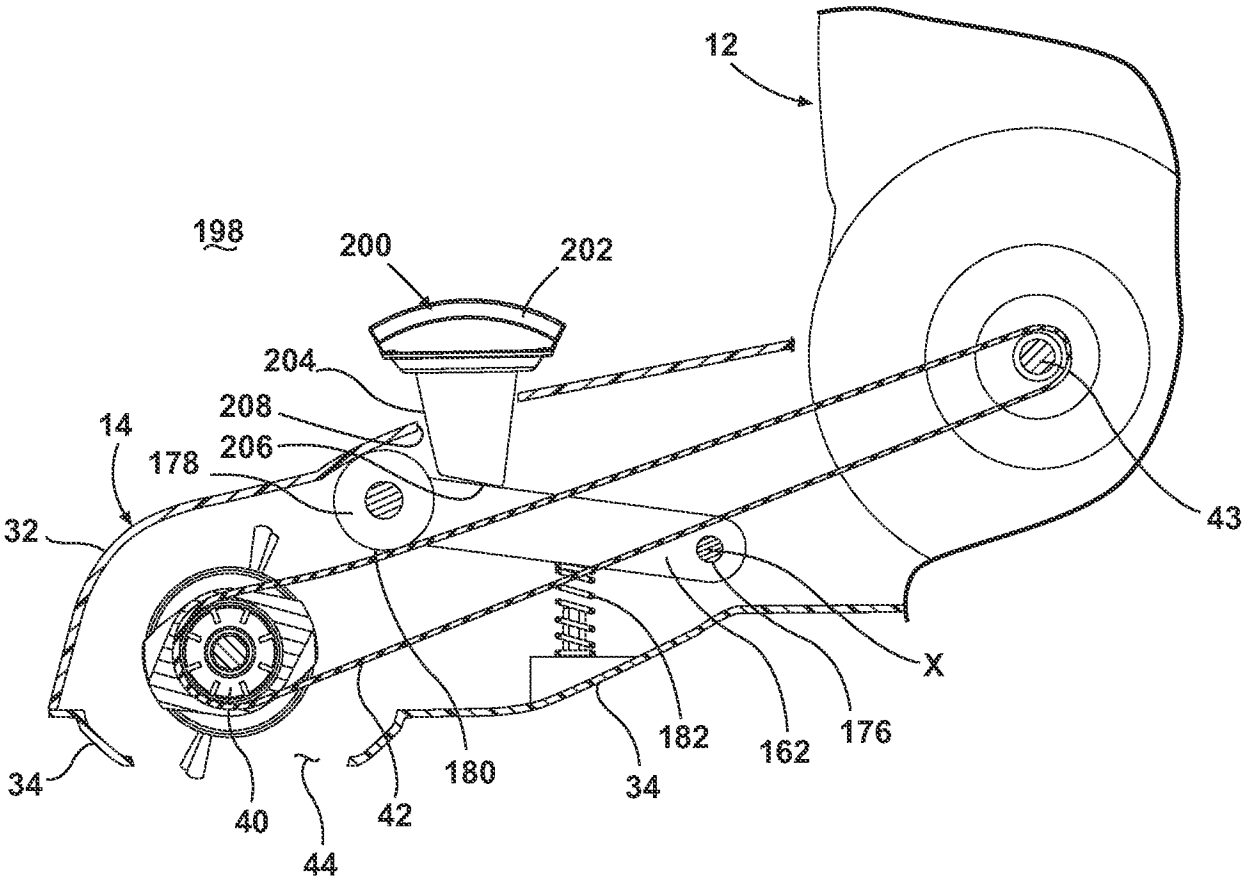
FIG. 14 is a side schematic view of the belt drive disengager from FIG. 12 in a disengaged position in which drive force is not transmitted to an agitator.

Referring to FIG. 14, to disengage the drive belt 42, the user rotates the dial 202 relative to the opening 208 in a second direction opposite the first direction, whereupon the wedge 204 rotates to decrease the height of the portion of the helically ramped profile 206 abutting the tensioner arm 162. The compressed coil spring 182 forces the tensioner arm 162 to rotate about the axis X defined by the pivot shaft 176, allowing the end of the tensioner arm 162 carrying the roller 178 to rise upwardly along the helically ramped profile 206 of the wedge 204. The roller 178 moves away from the drive belt 42, which removes tension from or creates slack in the drive belt 42 and disengages the motor shaft 43 from the agitator 40.

While the invention has been specifically described in connection with certain specific embodiments thereof, it is to be understood that this is by way of illustration and not of limitation, and the scope of the appended claims should be construed as broadly as the prior art will permit. The illustrated vacuum cleaner is but one example of the variety of vacuum cleaners with which this invention or some slight variant can be used. While shown and described for use with an upright vacuum cleaner, the belt drive disengager can be used with other types of vacuum cleaner, such as "stick"-type upright cleaners, canister vacuum cleaners, robotic vacuum cleaners, hand-held vacuum cleaners, or built-in central vacuum cleaning systems. For example, in a canister vacuum cleaner, the base assembly 14 can be configured as a floor nozzle that is coupled to a canister body via a wand-type handle and a vacuum cleaner hose. The belt drive disengager can also be used with vacuum cleaners adapted to dispense and/or take up fluids, such as extractors and steam cleaners. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A vacuum cleaner comprising:

a base assembly having a housing, a suction nozzle, and an agitator rotatably mounted to the housing;

a motor having a motor shaft;

a belt coupled between the agitator and the motor shaft;

a belt tensioner comprising a pivot mount mounted to the housing, a first leg extending from the pivot mount, and a second leg extending from the pivot mount in a different direction than the first leg; and an actuator assembly comprising a cam assembly provided in register with the second leg, the cam assembly comprising a cam and a cam follower operably interconnected with the cam;

wherein the actuator assembly is movably mounted to the housing between a first position in which the cam follower is located in a raised position and a second position wherein the cam follower is located in a lower position;

wherein movement of the actuator assembly between the first and second positions selectively pivots the belts tensioner to place tension on the belt in the first position with the first leg and to allow slack in the belt in the second position by abutment of the cam assembly with the second leg; and wherein the actuator assembly comprises a push-push mechanism, whereby actuating the actuator assembly once moves the cam follower to one of the raised and lowered positions, and actuating the actuator assembly again moves the cam follower to the other of the raised and lowered positions.

2. The vacuum cleaner according to claim 1 wherein the first leg comprises a belt-engaging surface in selective contact with the belt, wherein the belt-engaging surface is spaced from the pivot mount.

3. The vacuum cleaner according to claim 2 wherein the belt-engaging surface engages an outer surface of the belt.

4. The vacuum cleaner according to claim 2 wherein the belt engaging surface is provided by a roller that is rotatably mounted to the first leg.

5. The vacuum cleaner according to claim 4 wherein the roller is located at a distal end of the first leg.

6. The vacuum cleaner according to claim 4 wherein the roller has a circumferential groove for receiving the belt in at least the first position of the actuator assembly.

7. The vacuum cleaner according to claim 1 wherein the second leg comprises an abutment finger aligned with the cam follower and which is abutted by the cam follower in the second position.

8. The vacuum cleaner according to claim 7 wherein the abutment finger is located at a distal end of the second leg.

9. The vacuum cleaner according to claim 1 wherein the first and second legs are orientated at an obtuse angle, with the pivot mount as a vertex of the obtuse angle.

10. The vacuum cleaner according to claim 1, and further comprising a first spring positioned between the housing and the first leg for biasing the first leg toward the belt.

11. The vacuum cleaner according to claim 10, and further comprising a second spring for biasing the cam away from the cam follower.

12. The vacuum cleaner according to claim 1 wherein the actuator comprises a pedal provided on the base assembly and movably mounted to the housing.

13. The vacuum cleaner according to claim 1, and further comprising a spring for biasing the pedal away from the housing.

14. The vacuum cleaner according to claim 1 wherein the cam is mounted to the pedal.

15. The vacuum cleaner according to claim 1, and further comprising a cam guide which engages the cam follower for controlling movement of the cam follower relative to the cam.

16. The vacuum cleaner according to claim 15 wherein the cam guide is integrally formed with the housing.

17. The vacuum cleaner according to claim 1, and further comprising a pair of belt retention pins on the housing for preventing engagement of the belt with the motor shaft in the second position.

18. A vacuum cleaner comprising:

a base assembly having a housing, a suction nozzle, and an agitator rotatably mounted to the housing;

a motor having a motor shaft;

a belt coupled between the agitator and the motor shaft;

a belt tensioner comprising a pivot mount mounted to the housing, a first leg extending from the pivot mount, and a second leg extending from the pivot mount in a different direction than the first leg;

an actuator assembly comprising a cam assembly provided in register with the second leg, the cam assembly comprising a cam and a cam follower operably interconnected with the cam; and a cam guide which engages the cam follower for controlling movement of the cam follower relative to the cam;

wherein the actuator assembly is movably mounted to the housing between a first position in which the cam follower is located in a raised position and a second position wherein the cam follower is located in a lower position;

wherein movement of the actuator assembly between the first and second positions selectively pivots the belts tensioner to place tension on the belt in the first position with the first leg and to allow slack in the belt in the second position by abutment of the cam assembly with the second leg; and wherein the cam guide comprises a push-push track for the cam follower to move rotatably with respect to the cam guide and the cam.

19. The vacuum cleaner according to claim 18 wherein the cam guide comprises at least one deep groove and at least one shallow groove forming the push-push track.

20. The vacuum cleaner according to claim 18 wherein the first and second legs are orientated at an obtuse angle, with the pivot mount as a vertex of the obtuse angle.

* * * * *